US008590732B2

(12) United States Patent
Vandamme et al.

(10) Patent No.: US 8,590,732 B2
(45) Date of Patent: Nov. 26, 2013

(54) PACKAGE FOR FOOD PRODUCT TAKEN OUT WITH A MEASURING DEVICE

(75) Inventors: Patrick Vandamme, Lomme (FR); Frederic Bourdin, Meyzieu (FR); Francis Lovell, Montreuil (FR)

(73) Assignee: Compagnie Gervais Danone, Paris (FR)

( * ) Notice: Subject to any disclaimer, the term of this patent is extended or adjusted under 35 U.S.C. 154(b) by 559 days.

(21) Appl. No.: 12/599,588

(22) PCT Filed: May 7, 2008

(86) PCT No.: PCT/FR2008/050814

§ 371 (c)(1), (2), (4) Date: Nov. 10, 2009

(87) PCT Pub. No.: WO2008/149007

PCT Pub. Date: Dec. 11, 2008

(65) Prior Publication Data

US 2010/0308065 A1 Dec. 9, 2010

(30) Foreign Application Priority Data

May 11, 2007 (FR) ..... 07 03394

(51) Int. Cl.
*B65D 90/00* (2006.01)
*B65D 25/00* (2006.01)
*B65D 1/34* (2006.01)

(52) U.S. Cl.
USPC ..... 220/735; 220/212; 220/697; 206/553

(58) Field of Classification Search
USPC ..... 220/695–702, 735–742, 212, 574.1; 73/426; 206/556; 248/110
See application file for complete search history.

(56) References Cited

U.S. PATENT DOCUMENTS

| | | | | |
|---|---|---|---|---|
| RE24,012 | E * | 5/1955 | Horrocks | 220/695 |
| 5,706,974 | A * | 1/1998 | Murdick et al. | 220/735 |
| 6,604,645 | B1 * | 8/2003 | Vaupotic | 220/212 |
| 7,562,786 | B2 * | 7/2009 | Morrison | 220/212 |

(Continued)

FOREIGN PATENT DOCUMENTS

| | | |
|---|---|---|
| EP | 1157936 A | 11/2001 |
| FR | 2747107 A | 10/1997 |

OTHER PUBLICATIONS

French Preliminary Search Report in Corresponding Application FA696112/FR0703394 dated Nov. 14, 2007.

(Continued)

*Primary Examiner* — Bryon Gehman
*Assistant Examiner* — Shawn Braden
(74) *Attorney, Agent, or Firm* — Young & Thompson

(57) ABSTRACT

A package for a food product sampled using a metering device, including a receptacle (2) having a wide top opening (24) and defined by a rim (25), a closure system (3) including a cover (31) that can be moved between an open position and a closed position, and a first levelling element (41) having a top face (41*b*) and a free edge (41*a*) situated in the space of the opening. The package also includes a second levelling element (42) spaced apart from the first and also having a top face (42*b*) and a free edge (42*a*), wherein the top faces (41*b*, 42*b*) of the first and second levelling elements (41, 42) each have a configuration and are mutually arranged in order to form two spaced-apart bearing zones substantially parallel to the plane of the opening for supporting the metering device.

22 Claims, 3 Drawing Sheets

(56) References Cited

U.S. PATENT DOCUMENTS

| | | | | |
|---|---|---|---|---|
| 7,673,769 | B2 * | 3/2010 | McRorie, III | 220/735 |
| 8,042,704 | B2 * | 10/2011 | Borowski et al. | 220/574.1 |
| 2006/0156811 | A1 | 7/2006 | Borowski et al. | |
| 2008/0041861 | A1 * | 2/2008 | Crawford et al. | 220/697 |
| 2008/0156808 | A1 * | 7/2008 | Perry et al. | 220/560.03 |

OTHER PUBLICATIONS

International Search Report in Corresponding PCT/FR2008/050814 dated Dec. 1, 2009.

* cited by examiner

PACKAGE FOR FOOD PRODUCT TAKEN OUT WITH A MEASURING DEVICE

CROSS-REFERENCE TO RELATED APPLICATIONS

This application is a national stage application of International Application No. PCT/FR2008/050814, filed on May 7, 2008, which claims the benefit of French Patent Application No. 07 03394 filed on May 11, 2007, the entire contents of both applications being incorporated herein by reference.

BACKGROUND OF THE INVENTION

The present invention relates to a package for a food product taken out from the package using a predetermined utensil serving as a measuring device. More particularly, the invention relates to a package comprising:

- a container having a wide upper opening extending in a substantially horizontal plane and delimited by a perimeter;
- a closure system comprising a lid able to be moved between an open position and a closed position, wherein latter it covers the opening of the container; and
- a first leveling element having an upper face and a free edge located in the space of said opening.

A package of this type is known for example from document EP-A-1 157 936. The presence of a leveling element proves useful in practice for leveling the contents of a spoon or any other more complex measuring device by sliding the open side of the cup of this spoon past the free edge of this leveling element. Such a free edge may also be used to scrape the blade of a knife.

Nevertheless, when a granular or powdery product needs to be measured precisely, it is preferable for the user to use for each use the same utensil or measuring device the volume of which is precisely defined. Moreover, if variable volumes of product need to be measured, as is the case in particular for baby milk powder, where the volume to be taken out depends on the quantity of milk to be prepared, the measuring device may prove to be rather more complex than a simple spoon. It is therefore highly useful for the user to be able to retrieve the measuring device immediately for each use. However, for this purpose, the user should not have to carry out an unnatural or relatively tiresome operation at the end of the preceding use.

By contrast, a relatively widespread practice consists in simply replacing the measuring device on the top of the food product. However, simply taking hold of the measuring device may contaminate its handle with contaminants which may then come into contact with the food product if the measuring device is simply laid in the container.

SUMMARY OF THE INVENTION

It is therefore an object of the present invention to provide the user with a system enabling the particularly easy returning of a specific or nonspecific measuring device to the package, such that the user may retrieve this device during a subsequent use while limiting the risks of product contamination.

To this end, the subject of the present invention is a package of the abovementioned type which is characterized in that it comprises a second leveling element spaced apart from the first and also having an upper face and a free edge located in the space of said opening, the upper faces of the first and second leveling elements each having a configuration and being arranged with respect to one another such that they form two spaced-apart bearing zones extending substantially parallel to the plane of the opening of the container and on which a measuring device is able to rest.

Thus, by providing a second leveling element and arranging it in an opportune manner with respect to the first, bearing zones are provided which enable a measuring device to be returned to the package by using a very natural and simple movement to position it while preventing it from making any contact with the food product. The first and second leveling elements thus fulfill, according to the invention, a supporting function in addition to their leveling function. Even though the presence of two elements demands a little more material to produce the package, this is fully compensated for by the double role fulfilled by the first and second leveling elements. In addition, the leveling elements are clearly visible and used as soon as product is taken out from the box. As a result, their additional function as supports is easily understood by users, especially if their upper face bears an indication, such as a pictogram, for example.

In addition, the presence of two leveling elements is found to make it easier for left-handers to use the measuring system. This is because the leveling elements are quite often placed on the left of the package when it is facing the user in order to make leveling easier with the right hand, but this is disadvantageous for left-handers.

In preferred embodiments of the invention, use is furthermore made of one or other of the following arrangements:

- the opening of the container has a basically rectangular shape defining first and second opposing long sides and first and second opposing short sides of the perimeter, the first and second leveling elements being arranged at an angle in corners respectively adjacent to the first and second short sides of the perimeter;
- the lid is mounted such that it pivots about an axis along the first long side of the perimeter and the leveling elements are arranged in corners which are both adjacent to the second long side of the perimeter;
- the predetermined measuring device provided extends between a first end and a second end, said ends being spaced apart at a predetermined distance such that they rest on the first and second leveling elements and preferably at a predetermined distance which is slightly shorter than a long side of the opening;
- the predetermined measuring device provided extends between a first end having a cup and a second end defined by the free end of a handle and at least one of the upper faces of the first and second leveling elements has at least one positioning relief designed to engage with an end region of the predetermined measuring device;
- the lid has an inner face having at least one protruding immobilizing member arranged so as to be close to the measuring device positioned on the bearing zones of the first and second leveling elements and shaped so as at least to limit the possibility of said measuring device lifting with respect to said bearing zones when the lid is in the closed position, and preferably also so as to limit the possibilities of said measuring device moving in the plane of the opening;
- the first and second leveling elements constitute part of the perimeter of the opening and are formed in one piece with the container, and a peel-off membrane seal is sealed onto an annular strip of the perimeter of the opening;
- said at least one positioning relief on the first and second leveling elements is arranged in a region of the upper face of the leveling element located outside the outline defined by the annular sealing strip, said at least one relief preferably protruding from said upper face;

the annular sealing strip of the membrane seal is located as close as possible to the opening, and the membrane seal extends beyond the annular sealing strip at least partially above each of the upper faces of the first and second leveling elements so as to form first and second peeling-off tongues over said leveling elements;

said at least one positioning relief on the first and second leveling elements is formed by a hole designed to engage with a protruding part of the predetermined measuring device, said relief being arranged in a region of the upper face of the leveling element located inside the outline defined by the annular sealing strip;

the annular sealing strip of the membrane seal is formed by an annular relief protruding from the perimeter of the opening of the container;

the closure system also comprises a frame mounted on a neck of the container located close to the perimeter of the opening, on which neck the lid is hinged, and the first and second leveling elements are formed in one piece with said frame and arranged so as to be above the plane of the opening of the container;

the frame is made of injection-molded plastic and said at least one relief is an elastically deformable member protruding from the upper face of the first or second leveling element and designed to come into engagement with the predetermined measuring device;

the lid has an inner face having a coupling member designed to hold a predetermined measuring device against said inner face of the lid;

the lid has an inner face from which an annular belt extends which is arranged so as to have a free edge close to the perimeter of the opening when the lid is in the closed position; and the lid has a domed inner face having a profile designed to loosely clasp part of the predetermined measuring device with at least one of the first and second leveling elements.

BRIEF DESCRIPTION OF THE DRAWINGS

Further features and advantages of the invention will become apparent from the following description given by way of nonlimiting example with reference to the figures, in which.

DETAILED DESCRIPTION

Figure 1:
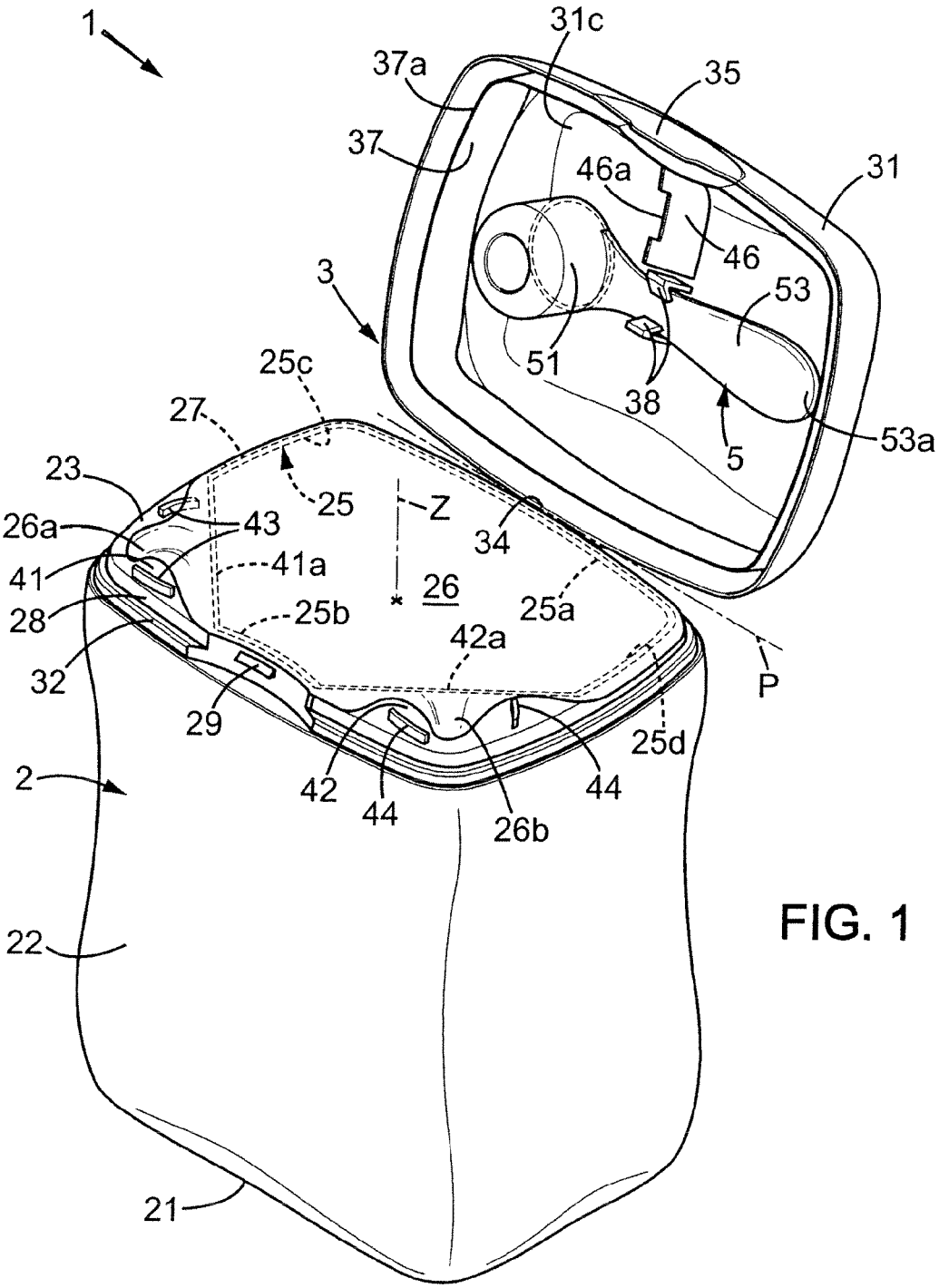
FIG. 1 is a schematic view of a first preferred embodiment of the package according to the invention, comprising a container closed by a peel-off membrane seal and a lid in the open position, in which lid a measuring device is placed.

In the various figures, identical reference numerals designate identical or similar elements.

FIG. 1 shows a package 1 comprising a container 2, a closure system 3 and a measuring device 5.

The container 2 has a base 21 from which an annular side wall 22 extends along a central vertical axis Z as far as an upper face 23. The upper face has a wide opening 24 surrounded by a perimeter 25. The perimeter 25 extends essentially in a horizontal plane coincident with the plane of the opening 24 and is formed by a collar extending radially toward the central axis Z. However, it is perfectly conceivable for this perimeter to be formed simply by the thickness of the material forming the side wall 22.

Perpendicular to the central axis Z, the container 2 has a basically rectangular cross section with rounded corners. This cross section varies somewhat along the central axis Z in order to form a waist for gripping, but these variations remain limited in order to ensure the vertical strength of the packages when they are stacked. Also for gripping purposes, the cross section preferably lies within a rectangle measuring 150 to 130 mm by 105 to 125 mm. The height from the base 21 to the upper face 23 is preferably between 130 and 170 mm in order to provide the customary volume for boxes intended to contain powdered baby milk. It is thus a relatively deep container, the opening 24 of which needs to be made as wide as possible in order to make it easier to extract powder from close to the base 21 of the container 2.

Due to this basically rectangular cross section, the perimeter 25 of the opening of the container 2 may be considered to have a first long side 25*a*, a second opposing long side 25*b* and first and second short sides 25*c*, 25*d* connecting the long sides.

The container 2 is produced in one piece from blow-molded plastic. This plastic is preferably a multilayer compound forming a very effective oxygen barrier when the product is milk powder, for example. However, it may, of course, be a container produced from another material, in particular metal or multilayer board.

The wide opening 24 of the container 2 is closed by a membrane seal 26, shown in FIG. 1, which is sealed onto an annular sealing strip 27 indicated by dashed lines. This sealing strip 27 is in the form of a slightly protruding bead, but it could be perfectly flat. Thus, the milk powder is perfectly preserved in the container 2 until used for the first time when the membrane seal 26 is peeled off with the aid of one of the portions 26*a* or 26*b* of the membrane seal which constitute peeling-off tongues.

Figure 4:
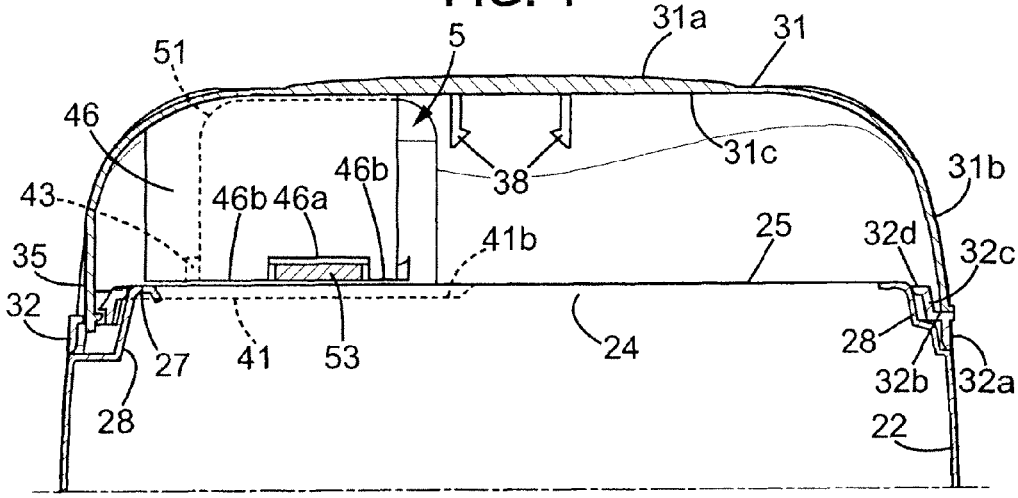
FIG. 4 is a partial cross-sectional view on the line IV-IV in FIG. 2 with the lid in the closed position.

As can be seen more clearly in FIG. 4, the container 2 has a stepped neck 28 between the top of its annular wall 22 and its upper face 23. As will be explained below, the presence of this neck 28 enables the mounting of a frame for the closure system 3.

The closure system 3 first of all comprises a lid 31 having a relatively domed shape such that it may be considered to have a substantially flat upper portion 31*a* and an annular peripheral portion 31*b* substantially coaxial with the central axis.

The lid 31 also has an inner face 31*c* oriented toward the opening 24 in the closed position, this inner face being basically dish-shaped due to the domed shape of the lid 31.

The closure system 3 further comprises a frame 32 mounted with a tight fit on the neck 28 of the container 2. The frame 32 is fastened nondetachably to this part of the container, in particular by snap fastening, but could also be fastened by adhesive bonding or welding.

The frame 32 has an external periphery 32*a* continuing the side wall 22 of the container 2, followed by an inward recess 32*b*, then an annular portion 32*c* extending as far as an upper face 32*d* of the frame. The upper face 32*d* of the frame extends horizontally in a plane parallel to the plane of the opening 24 comprising the perimeter 25, and slightly below this plane in the embodiments shown. This prevents the frame from interfering with the membrane seal 26 sealed onto the perimeter 25. The radially inner end of the upper face 32*d* constitutes here the inner periphery of the frame 32 which is adjacent to the neck 28 of the container. The upper face 32*d* of the frame forms with the perimeter 25 of the opening 24 the upper face 23 of the container part.

However, it is perfectly conceivable for the membrane seal 26 to be sealed onto the frame 32, depending on the nature of the food product contained and depending on the degree of sealing obtained between the neck 28 of the container 2 and this frame 32. In such a case, it is then preferable for the upper face 32*d* of the frame to be located above the plane of the perimeter 25 of the opening 24 and possibly for it to extend toward the central axis Z in order to cover the perimeter 25.

The lid 31 and the frame 32 are hinged together by a connection 34 enabling the lid 31 to move with respect to the frame 32 and to the container 2 between an open position, shown in FIG. 1, in which the opening 24 is easily accessible, and a closed position, shown in FIG. 4, in which the lid 31 covers this opening. It is thus a reclosable package of which the lid is handled each time it is used, for example for preparing babies' bottles.

In this case the connection 34 is a hinge connection, the pivot axis P of which is perpendicular to the central axis Z. More precisely, the pivot axis P is parallel and located close to the first long side 25*a* of the perimeter 25.

In the embodiment shown, it is a plastic hinge formed by a fold line enabling the lid 31 and the frame 32 to be produced as a single part. Said part is obtained by injection-molding a plastic, for example polypropylene. However, the hinge connection 34 could of course also be produced as two separate parts joined together and it is likewise possible to provide some other type of connection between the frame and the lid, or even to do without a frame by employing a lid mounted removably on the neck 28 of the container 2.

The locking device comprises a lug 35 integral with the lid 31 and engaging with a nose 29 protruding from the neck 28 of the container. The locking device produced in this form, or in any other form, is intended to prevent any accidental escape of product once the package has been opened for the first time when the membrane seal 26 has been peeled off, but is not intended to provided a sealed closure such as was obtained previously with the membrane seal.

As can be seen in FIGS. 1 and 4, the inner face 31*c* of the lid has an annular belt 37 extending downward in the direction of the axis Z as far as a free edge 37*a* arranged so as to be close to the perimeter 25 of the opening of the container 2 such that it increases the degree of closure of the container without, however, producing an airtight closure.

As can be seen clearly in FIG. 1, the inner face 31*c* of the lid 31 also has a coupling member 38, formed here by two elastic lugs having inclined noses and facing one another, in order to hold the measuring device 5 against the inner face of the lid. The coupling member 38 produced in this manner holds the measuring device 5 by snap fastening such that the latter can be repositioned against the lid after being used for the first time. However, for reasons that will become apparent below, it is perfectly possible to produce the coupling member 38 from breakable elements which are only able to hold the measuring device 5 until it is used for the first time.

With regard to the measuring device 5, this is similar to a spoon in the embodiment shown, that is to say it has a cup 51 which defines a fixed measuring volume and is substantially cylindrical up to the open side of this cup. A handle 53 extends from the cup 51 as far as a free end 53*a*. The measuring device 5 thus has an elongate form having a first end region 51*a* defined by the part of the cup opposite the handle 53 and a second end region encompassing the free end 53*a* of the handle.

The device 5 shown in the figures is a measuring device of predetermined form designed to be sold with the package and the fixed measuring volume of which is specific to the food product in question. Using a predetermined measuring device 5 enables the package elements, such as the coupling member 38, to be configured such that they engage tightly with a portion of the measuring device that has a known and precise geometry. However, the package could also be used with a standard teaspoon or tablespoon, with some of its advantages still being obtained.

Figure 2:
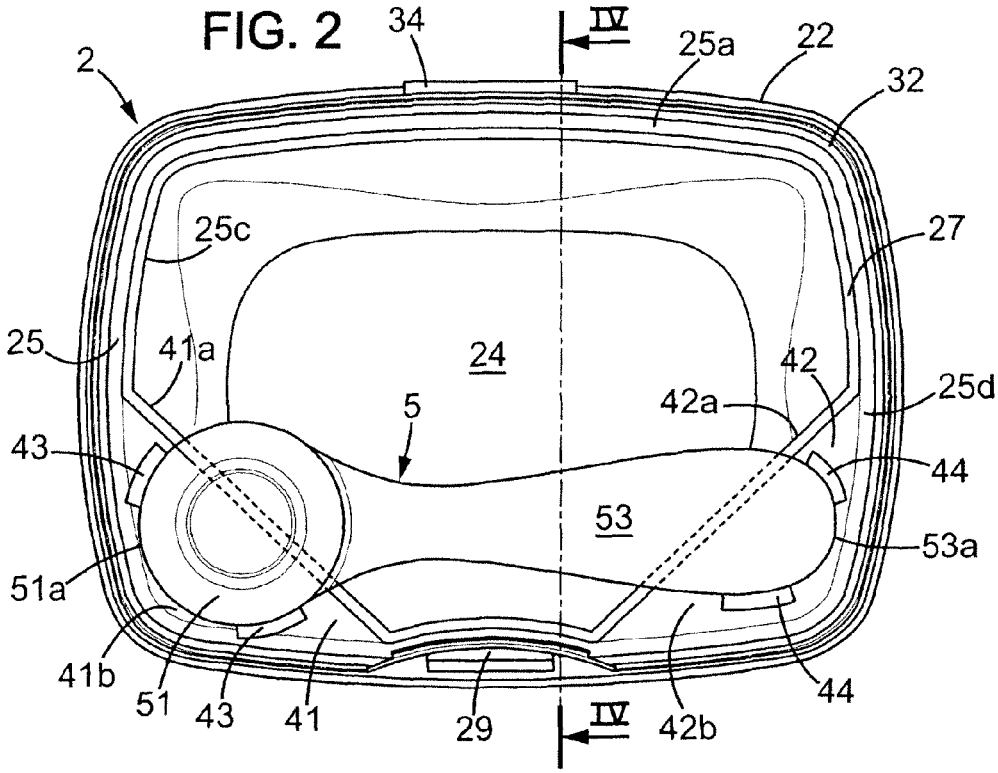
FIG. 2 is a top view of the container from FIG. 1 from which the membrane seal has been peeled off and on which the measuring device is resting.

As can be seen more clearly in FIG. 2, the package 1 comprises a first leveling element 41 and a second leveling element 42, each having a free edge (41*a*; 42*a*) located in the space of the opening 24 of the container. It should be understood from the expression "space of the opening" that the free edges (41*a*; 42*a*) can be located precisely in the plane of the opening 24 defined by the perimeter 25, but also a little above or below this plane as long as they fulfill their primary function, namely to level off the product contained in the measuring device 5.

Leveling is performed by sliding the open side of the cup 51 of the measuring device 5 against the free leveling edge (41*a*; 42*a*), thereby obtaining a volume of product in the measuring device which corresponds very precisely to the volume of the cup 51. For this purpose, each of the free edges (41*a*, 42*a*) must have a rectilinear portion having a length at least equal to the open side of the cup 51. This is because, if there were no rectilinear portion, for example if there were a concave free edge, the powder would not be leveled off correctly at the top of the open side, and what is worse, in the case of a convex free edge, the protruding part thereof could catch on the cup and cause powder to tip out. On the other hand, it is necessary for each of the leveling edges 41*a*, 42*a* to protrude sufficiently into the interior from the side wall 22 of the container so that the user is not obliged to incline the measuring device 5 almost vertically which could cause some of the product to fall out and thereby lead to a mismeasurement.

Moreover, each of the first and second leveling elements (41; 42) has an upper face (41*b*; 42*b*) having a certain size and basically located in a horizontal plane coincident with the plane of the opening 24. Nevertheless, it is possible for the upper faces (41*b*, 42*b*) to be inclined so as, for example, to slope toward the central axis and thus make it easier to return powder spillages into the container 2.

The upper faces (41*b*, 42*b*) each have a configuration and are arranged with respect to one another so as to form two spaced-apart bearing zones onto which it is easily possible to put the measuring device 5. The measuring device 5 rests on these bearing zones (41*b*, 42*b*) away from the food product contained, in the container whether it is a measuring device of predetermined form or a simple spoon.

The bearing zones of the upper faces (41*b*, 42*b*) extend in a horizontal plane in order that the measuring device 5 rests simply by virtue of gravity and parallel to the plane of the opening 24 in order to minimize the space necessarily taken up in the package 1. However, it is possible for the measuring device 5 stored in this way to have a certain inclination or else to engage with nonflat bearing zones creating a certain amount of friction.

It should be noted that the measuring device 5 has a predetermined distance between its first and second ends (51*a*, 53*a*), in order that the latter rest on the first and second leveling elements (41, 42). Preferably, this predetermined distance is slightly shorter than a long side of the opening 24. It is clear that such a length offers a good compromise between the capacity to extract powder from the bottom of the container 2 and the ease of storing the measuring device on the leveling elements. As can be seen more clearly in FIG. 2, the leveling elements are formed by basically triangular wings arranged in the corners of the perimeter 25 of the opening in order that their respective free edges (41*a*, 42*a*) are oriented at approximately 45 degrees to the short sides (25*c*, 25*d*) of the perimeter which are adjacent to these corners.

In addition, these first and second leveling elements are both adjacent to the second long side 25*b* of the perimeter, that is to say the side opposite the hinge 34 of the lid 31. This configuration proves to be particularly practical not only for right-handed users but also for left-handers when carrying out leveling. In addition, such an arrangement does not impose an excessive length on the measuring device 5 for certain configurations of the container, given that the opening 24 thereof must be relatively wide. This advantageous arrangement of the first and second leveling elements (41, 42) could also be obtained with a nonrectangular, for example circular, opening 24.

It should also be noted in this embodiment that the leveling elements are formed in one piece with the container 2 and thus constitute part of the perimeter 25 of the opening. This arrangement has, in addition to an economic advantage, an advantage with respect to the membrane sealing of the container.

Specifically, it is thus advantageous for the annular sealing strip 27 to be arranged as close as possible to the opening 24 and thus adjacent to the leveling edges (41*a*, 42*a*). Thus, firstly the surface closed by the membrane seal 26 is minimized and secondly the peeling-off tongues (26*a*, 26*b*) can be arranged above the leveling elements (41, 42). They are thus easier to take hold of than smaller peeling-off tongues folded down at the periphery of the upper face of the box. Similarly, the advantageous arrangement for left-handers and right-handers is also apparent for the peeling-off tongues (26*a*, 26*b*) by virtue of this arrangement.

It should also be noted that by placing positioning reliefs (43, 44) which protrude with a suitable height into this outer region, the peeling-off tongues (26*a*, 26*b*) can be lifted easily which makes them easier to grasp.

The role of the bearing zones on the upper faces (41*b*, 42*b*) of the leveling elements can be easily understood by the user if pictograms are etched or printed on them. It appears advantageous, however, to provide one or more positioning reliefs (43, 44) on at least one of the upper faces (41*b*, 42*b*) of the leveling elements (41, 42), said positioning reliefs being designed and arranged to engage more or less tightly with the measuring device 5, particularly if the latter is a standard utensil or a measuring device of predetermined form.

More particularly, in the embodiment shown, the first leveling element 41 has on its upper face 41*b* two circularly arcuate guards 43 arranged around the outer outline of the first end region 51*a* of the measuring device 5. The second leveling element 42 also has two circularly arcuate guards 44 which are arranged around the outline of the second end region formed by the end 53*a* of the handle. Thus, besides a visual indication of the possibility of positioning the measuring device 5, it is possible to immobilize this measuring device in the plane of the perimeter 25, particularly in order to prevent it from falling into the container 2 as a result of the package 1 being handled more or less roughly.

In this first embodiment, the reliefs (43, 44) of the leveling elements (41, 42) thus protrude, but they could also be recesses or even through-holes as will become apparent from the description of the second embodiment.

Figure 3:
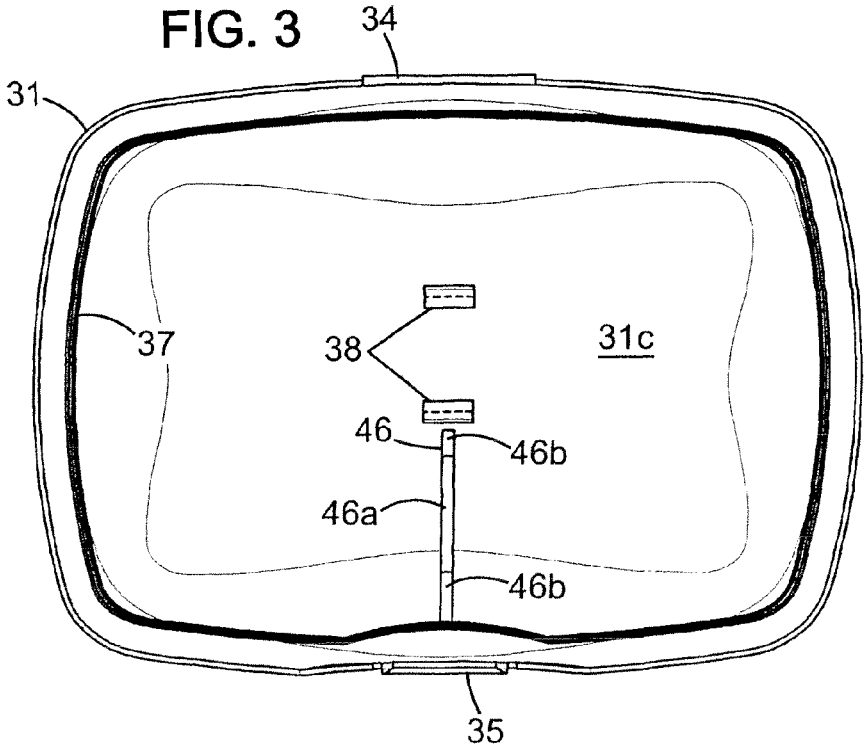
FIG. 3 is a bottom view of the lid from FIG. 1 without the measuring device.

In order further to immobilize the measuring device 5 when it rests on the bearing zones of the leveling elements (41, 42) and more particularly in order to prevent the measuring device 5 from lifting off these zones and falling into the container if the package is handled severely, at least one immobilizing member 46 is arranged on the inner face 31*c* of the lid 31. This member 46 can be seen in FIGS. 1, 3 and 4 and is in the form of a panel extending vertically downward as far as a free edge having an indentation 46*a*. The indentation 46*a* is positioned and located at a distance from the inner face 31*c* of the lid so as to be just above a mid-portion of the handle 53 of the measuring device 5, and preferably at a distance less than the depth of engagement of the measuring device with the reliefs (43, 44) of the leveling elements. Thus, when the lid 31 is in the closed position shown in FIG. 4, the measuring device cannot leave its storage position on the bearing zones of the leveling elements (41, 42). The immobilizing member 46 also has on both sides of the indentation 46*a* extended portions 46*b* limiting, just like the reliefs 43, 44, any possibility of the measuring device moving in a direction parallel to the plane of the opening 24. This immobilization is all the more effective if a measuring device 5 of predetermined form is provided.

The immobilizing member 46 could also form an integral part of the annular belt 37 in a variant which is not shown. Specifically, this belt 37 could be vertically beneath the annular sealing strip 27 shown in FIG. 2 and have indentations of a suitable height for the cup and the handle 53 in the regions of the annular sealing strip 27 shown by the dotted lines in this figure.

With the same aim, and as can be seen in FIG. 4, the profile of the inner face 31*c* of the domed lid 31 is determined such that this inner face clasps the measuring device 5 and more precisely its cup 51 when it rests on the leveling elements (41, 42) and the lid 31 is in the closed position.

Figure 5:
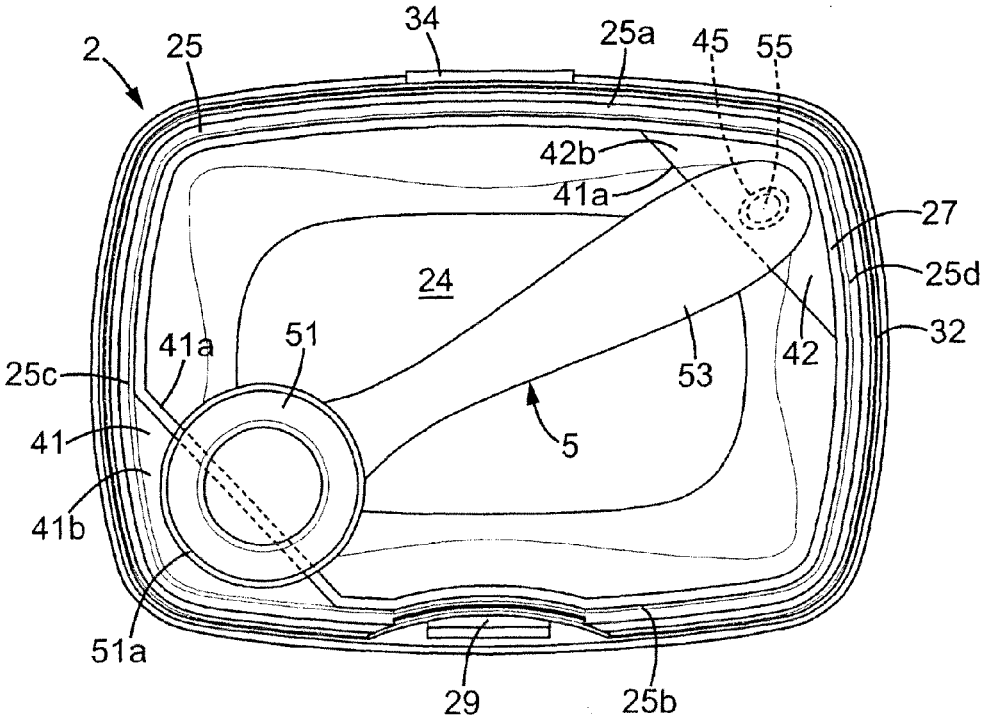
FIG. 5 is a view similar to FIG. 2 of a second embodiment of the package.

A second embodiment of the package is shown in FIG. 5 in a view analogous to that of the first embodiment in FIG. 2. In this second embodiment, the first and second leveling elements (41, 42) are still formed by triangular wings formed in one piece with the perimeter 25 of the container 2, but are arranged diagonally, that is to say with a first leveling element 41 located in the corner adjacent to the first short side 25*c* and to the second long side 25*b* of the perimeter while the second leveling element 42 is located in the corner adjacent to the second short side 25*d* and to the first long side 25*a*. The measuring device 5 can then have a longer form which may prove useful in the case of a taller, narrower container.

It should be noted that in this embodiment the upper face 41*b* of the first leveling element has no relief except the bead of the annular sealing strip 27 which in this case is adjacent to the free edges 41*a*. The upper face 42*b* of the second leveling element 42 has in this case a relief 45 formed by a through-hole, through it could be a well. The measuring device 5 then has a projection 55 having a complementary form on the end region 53*a* bearing against the bearing zone of the second leveling element 42 in order to engage with the recess 45. The hole 45 and the projection 55 have concentric ovoid cross sections, or any other noncircular form. Thus the positioning relief formed by the hole 45 not only limits the translational movement of the second end 53*a* of the measuring device 5 but also fixes the longitudinal orientation of the latter such that the first end 52*a* is above the first leveling element 41.

It should be noted that at the second leveling element 42 the annular sealing strip 26 follows the outer periphery of the perimeter 25. Subsequently, the relief formed by the hole 45 may pass through the leveling element 42 which is in the form of a wing of the same thickness as the side wall 22 of the container without affecting the sealing when the container is closed by the membrane seal 26 before being used for the first time. Of course, the measuring device 5 may be held against the inner face 31*c* of the lid before the first use, for example by means of a coupling member similar to the first embodiment but arranged diagonally with respect to the lid 31.

The method of manufacturing and using the package 1 may proceed, inter alia, in the following manner. Containers 2 having as yet no closure system 3 are conveyed on a line where they are filled with baby milk powder and after filling are immediately sealed hermetically by the membrane seal 26. Any protruding reliefs (43, 44) located outside the annular sealing strip 27 do not hamper this membrane sealing operation and this also applies in the case of any recesses 45.

Next, the closure system 3 comprising the lid 31 and the frame 32 and also the predetermined measuring device 5 coupled to the lid to prevent handling is mounted on the neck 28 of the container 2, preferably by snap fastening. It should be noted that the peeling-off tongues (26*a*, 26*b*) do not interfere with this mounting operation given that they do not extend beyond the upper faces (41*b*, 42*b*) of the leveling elements (41, 42).

When the package is used for the first time, the user peels off the membrane seal 26 and uncouples the measuring device 5 from the inner face of the lid 31. Any pictograms or reliefs (43, 44) on the leveling elements (41, 42) are then perfectly visible. The user takes the required amount of product by digging into the powder in the container 2 using the measuring device 5. The volume of powder is leveled off by sliding the open side of the cup 51 along the free edge 41*a* of the first leveling element, or along the free edge 42*a* of the second leveling element if he is a left-hander.

After taking the required quantity, the user rests the measuring device in a natural manner on the first and second leveling elements (41, 42) which then form supports, the open side of the cup 52 either being oriented toward the upper face 41*a* of the first leveling element or toward that of either of the first and second leveling elements (41, 42) if the latter have identically configured positioning reliefs (43, 44; 45). The measuring device is then held in position and immobilized in this position after the lid has been closed by virtue of the immobilization member 46 and/or by virtue of the configuration of the inner face 31*c* of the domed lid. This immobilization has a certain amount of play in order that the plastic parts do not have to be given a very precise form, the aim being simply to prevent the measuring device 5 from falling into the container 2 if the package is handled energetically.

When the package is used the next time, the measuring device 5 is immediately visible and can be withdrawn very easily if it is only resting lightly on the corresponding zones of the first and second leveling elements (41, 42).

Of course, the embodiments described above are in no way limiting, their features can be combined and other variants are conceivable. It is in particular possible to produce leveling elements formed in one piece with the frame 32 of the closure system 3. In that case, it is preferable for the upper face 32*d* of the frame 32 to be located above the perimeter 25 of the opening of the container 2 and for the leveling elements 41, 42 to be in the form of wings covering this frame and part of the opening 24. If this opening 24 is closed by a membrane seal, attention must be paid to the ease of peeling the latter off. It should be noted that in that case the leveling elements are produced, in the same way as the frame, from injection-molded plastic. This enables geometric forms which are rather more precise and more complex than in the case of a thermoformed or blow-molded container 2. It is then possible to provide for at least one of the reliefs on the upper face of a leveling element to be an elastically deformable member protruding from this face. This makes it possible to hold the measuring device 5 against the first and second leveling elements by snap fastening and without an immobilizing member, or else to provide greater adaptability to the geometry of the measuring member, especially if the latter does not have a well-known predetermined form.

The invention claimed is:

1. A package for a food product taken out with a predetermined measuring device, comprising:

a container having a wide upper opening extending in a substantially horizontal plane and delimited by a perimeter;

a closure system comprising a lid able to be moved between an open position and a closed position, said lid covering said opening of the container in the closed position;

a first leveling element having an upper face and a free edge located in the space of said opening; and a second leveling element spaced apart from said first leveling element and also having an upper face and a free edge located in the space of said opening, said upper faces of the first and second leveling elements each having a configuration and being arranged with respect to one another such that they form two spaced-apart bearing zones extending substantially parallel to said plane of the opening of the container and on which a measuring device is able to rest;

wherein said first and second leveling elements constitute part of said perimeter of the opening, and wherein a peel-off membrane seal is sealed onto an annular sealing strip of said perimeter of the opening, and said annular sealing strip of the membrane seal is adjacent to said opening, said membrane seal extending beyond said annular sealing strip at least partially above each of said upper faces of the first and second leveling elements so as to form first and second peeling-off tongues over said leveling elements.

2. The package as claimed in claim 1, wherein said first and second leveling elements are formed in one piece with said container.

3. A package for a food product, comprising:

a container having an annular side wall that extends along a central vertical axis and a wide upper opening extending in a substantially horizontal plane and delimited by a perimeter, the annular side wall extending from a base as far as an upper face of the container, the container having a top;

a closure system comprising an annular frame mounted on the top of the container, a lid able to be moved between an open position and a closed position, a hinge connection between the lid and the frame, the frame comprising a first long side and a second long side parallel to the first long side, the hinge connection being provided along said first long side, said lid covering said opening of the container in a closed position;

a predetermined measuring device comprising a first end having a cup and a second end, the predetermined measuring device extending between said first end and said second end, said cup being provided with an open side;

a first leveling element having an upper face and a free edge located in the space of said opening, said free edge locally protruding inwardly and having a rectilinear continuous portion having a length at least equal to the open side of the cup and proximal relative to the central vertical axis, the first leveling element being adjacent to the second long side of the frame; and a second leveling element spaced apart from said first leveling element and also having an upper face and a free edge located in the space of said opening, the free edge of the second leveling element having a rectilinear continuous portion having a length at least equal to the open side of the cup and proximal relative to the central vertical axis, the second leveling element being adjacent to the second long side of the frame, said upper faces of the first and second leveling elements each having a configuration and being arranged with respect to one another such that they form two spaced-apart bearing zones extending substantially parallel to said plane of the opening of the container and on which said measuring device is able to rest, wherein said opening of the container has a basically rectangular shape with four sides and four corners, the rectilinear continuous portion of the first leveling element defining a direction that intersects a first side and a second side of said four sides and the rectilinear continuous portion of the second leveling element defining another direction that intersects said first side and a third side of said four sides.

4. The package as claimed in claim 3, wherein said opening of the container has the basically rectangular shape defining the first and second opposing long sides and first and second opposing short sides of said perimeter, said first and second leveling elements being arranged at an angle in corners respectively adjacent to said first and second short sides of the perimeter.

5. The package as claimed in claim 4, wherein said lid is mounted such that it pivots about an axis along said first long side of the perimeter and wherein said first and second leveling elements are arranged in corners which are both adjacent to said second long side of the perimeter.

6. The package as claimed in claim 3, wherein said first end and said second end of the predetermined measuring device are spaced apart at a predetermined distance such that the first end and the second end of the predetermined measuring device rest on said first and second leveling elements.

7. The package as claimed in claim 6, wherein said first and second ends of the predetermined measuring device are spaced apart at a predetermined distance which is slightly shorter than a long side of said opening.

8. The package as claimed in claim 3, wherein at least one of said upper faces of the first and second leveling elements has at least one positioning relief designed to engage with an end region of said predetermined measuring device.

9. The package as claimed in claim 8, wherein said first and second leveling elements constitute part of said perimeter of the opening and are formed in one piece with said container, and wherein a peel-off membrane seal is sealed onto an annular sealing strip of said perimeter of the opening.

10. The package as claimed in claim 9, wherein said annular sealing strip defines an outline and said at least one positioning relief comprises a relief arranged in a region of one of said upper faces of the first and second leveling elements located outside the outline defined by said annular sealing strip.

11. The package as claimed in claim 10, wherein said relief protrudes from said upper face.

12. The package as claimed in claim 9, wherein said annular sealing strip of the membrane seal is adjacent to said opening, and wherein said membrane seal extends beyond said annular sealing strip at least partially above each of said upper faces of the first and second leveling elements so as to form first and second peeling-off tongues over said leveling elements.

13. The package as claimed in claim 9, wherein said at least one positioning relief comprises a relief formed by a hole designed to engage with a protruding part of said predetermined measuring device.

14. The package as claimed in claim 9, wherein said annular sealing strip of the membrane seal is formed by an annular relief protruding from said perimeter of the opening of the container.

15. The package as claimed in claim 3, wherein said lid has an inner face having at least one protruding immobilizing member arranged so as to be close to said measuring device positioned on said two spaced-apart bearing zones and shaped so to as at least limit the possibility of said measuring device lifting with respect to said spaced-apart bearing zones when said lid is in the closed position, and also so as to limit the possibilities of said measuring device moving in said plane of the opening.

16. The package as claimed in claim 3, wherein said closure system also comprises a frame mounted on a neck of said container located close to said perimeter of the opening and on which said lid is hinged, and wherein said first and second leveling elements are formed in one piece with said frame and arranged so as to be above said plane of the opening of the container.

17. The package as claimed in claim 16, wherein at least one of said upper faces of the first and second leveling elements has at least one positioning relief designed to engage with an end region of said measuring device, and said frame is made of injection-molded plastic and wherein said at least one positioning relief is an elastically deformable member protruding from said upper face of the first or second leveling element and designed to come into engagement with said measuring device.

18. The package as claimed in claim 3, wherein said lid has an inner face having a coupling member designed to hold a measuring device against said inner face of said lid.

19. The package as claimed in claim 3, wherein said lid has an inner face from which an annular belt extends which is arranged so as to have a free edge close to said perimeter of the opening when said lid is in the closed position.

20. The package as claimed in claim 3, wherein said lid has a domed inner face having a profile designed to loosely clasp part of said measuring device with at least one of said first and second leveling elements.

21. The package as claimed in claim 3, wherein the annular side wall comprises four sides and wherein said rectilinear continuous portion of the first leveling element defines with two adjacent sides of said four sides of the annular side wall a triangular shape.

22. The package as claimed in claim 3, wherein the annular side wall comprises four sides and wherein each of said rectilinear continuous portions defines with two adjacent sides of said four sides of the annular side wall a triangular shape.

* * * * *

UNITED STATES PATENT AND TRADEMARK OFFICE

CERTIFICATE OF CORRECTION

PATENT NO. : 8,590,732 B2
APPLICATION NO. : 12/599588
DATED : November 26, 2013
INVENTOR(S) : Vandamme et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 673 days.

Signed and Sealed this
Twenty-second Day of September, 2015

Michelle K. Lee

Michelle K. Lee
*Director of the United States Patent and Trademark Office*